United States Patent [19]

Tanaka et al.

[11] Patent Number: 4,700,805

[45] **Date of Patent: * Oct. 20, 1987**

[54] MUFFLER FOR EXHAUST GAS FROM INTERNAL COMBUSTION ENGINE

[75] Inventors: Hideharu Tanaka; Mutsuo Sekiya; Fusaoki Uchikawa, all of Hyogo, Japan

[73] Assignee: Mitsubishi Denki Kabushiki Kaisha, Tokyo, Japan

[ * ] Notice: The portion of the term of this patent subsequent to Jun. 18, 2002 has been disclaimed.

[21] Appl. No.: 723,990

[22] Filed: Apr. 16, 1985

[30] Foreign Application Priority Data

Sep. 20, 1984 [JP] Japan ..... 198242

[51] Int. Cl.[4] ..... F01N 1/10

[52] U.S. Cl. ..... 181/265; 181/252; 181/256; 181/268; 181/272

[58] Field of Search ..... 181/227, 249, 250, 252, 181/256, 255, 265, 266, 268, 272, 248

[56] References Cited

U.S. PATENT DOCUMENTS

| | | | |
|---|---|---|---|
| 2,043,731 | 6/1936 | Bourne | 181/248 |
| 2,614,647 | 10/1952 | Bryant . | |
| 3,469,653 | 9/1969 | Vautaw et al. | 181/266 |
| 3,613,830 | 10/1971 | Hubbell, III | 181/266 |
| 4,523,830 | 6/1985 | Tanaka et al. | 181/249 |

FOREIGN PATENT DOCUMENTS

| | | |
|---|---|---|
| 0092589 | 11/1983 | European Pat. Off. . |
| 517969 | 3/1940 | United Kingdom . |
| 1574480 | 9/1980 | United Kingdom . |

*Primary Examiner*—Benjamin R. Fuller

*Attorney, Agent, or Firm*—Sughrue, Mion, Zinn, Macpeak and Seas

[57] ABSTRACT

A muffler for exhaust gases of an internal combustion engine. The muffler is a hybrid consisting of gas expansion chambers defined by partitions in a muffler casing, and a sound-absorbing body. The sound-absorbing body includes a perforated pipe surrounded by a porous sound-absorbing material with a thin metal film sandwiched therebetween.

10 Claims, 11 Drawing Figures

MUFFLER FOR EXHAUST GAS FROM INTERNAL COMBUSTION ENGINE

BACKGROUND OF THE INVENTION

The present invention relates to a muffler for an exhaust gas from an internal combustion engine (hereinafter simply referred to as a muffler for an exhaust gas) and more particularly aims to widen the range of sound-deadening performance of the muffler.

FIGS. 1(*a*) and 1(*b*) show schematic diagrams of the conventional muffler for an exhaust gas. In the drawings, the reference numeral 1 designates an inlet pipe, 2 a casing of a muffler for exhaust gas, 3 a perforated pipe made of punched metal, 4 an outlet pipe, and 5 a sound-absorbing material filled in a space formed by the perforated pipe 3 and the casing 2. Usually, fibrous sound-absorbing materials, such as glass or rock wool, are used as the sound-absorbing material. The inlet pipe 1, the perforated pipe 3, and the outlet pipe 4 are disposed serially to constitute an exhaust gas passage 6. In the thus arranged muffler for an exhaust gas, the exhaust gas entering the inlet pipe 1 passes through the perforated pipe 3 and the outlet pipe 4 and is scattered into the air. The sound accompanying the exhaust gas propagates into slender interstices in the sound-absorbing material 5, causing acoustic energy of the exhaust gas sound to be converted into heat energy by a viscosity effect, so that the sound is deadened.

A disadvantage of such conventional mufflers is that the sound-deadening performance deteriorates remarkably with age. There are several reasons for this. First, the aperture portions in the sound-absorbing material become clogged because combustion remnants (such as soot, tar) in the exhaust gas enter the aperture portions and adhere thereto. Second, since the sound-absorbing material is fibrous, the fabric may be scattered by the exhaust gas. Third, since the sound-absorbing material completely fills the casing, the effect of its heat insulation properties is large and the interior of the casing will have a relatively low temperature, causing steam in the exhaust gas to condense. The condensed steam combines with a sulfur dioxide gas, or the like, to form a strongly acidified compound, thereby corroding the casing and permitting the sound to be radiated in the air therefrom.

Applicants have made a study for the purpose of avoiding the problem of age deterioration in conventional mufflers as described above. As a result, Applicants have found that the aforementioned second and third problems could be solved in the manner illustrated in FIGS. 2(*a*) and 2(*b*). The exhaust gas is prevented from scattering by using a metallic porous body 7 as a sound-absorbing material, and the corrosion problem of the casing is solved by providing a rear air layer 8 between the metallic porous body 7 and the casing 2 to avoid a large temperature reduction in the casing 2 in order to suppress generation of condensed water. The reference numeral 71 designates that the sound-absorbing body is porous. The sound-absorbing material (the metallic porous body) is quite hard and may be a frame member.

While the device of FIGS. 2(*a*) and 2(*b*) solves the second and third causes of age deterioration, it does not diminish the first cause, namely, clogging of openings, which is the main cause of age deterioration. Applicants have found that prevention of clogging of the sound-absorbing material can be accomplished by forming an airtight thin film on the surface of the sound-absorbing material with which an exhaust gas comes into contact to thereby block the flow of the gas into the material. In general, the forming of such a thin film reduces the propagation of the sound wave itself into the sound-absorbing material, thereby deteriorating the sound-absorbing properties of the muffler. However, Applicants have found that the sound-absorbing performance of such a muffler can be improved relative to a muffler with no thin film, by properly adjusting the thickness of the thin film and the aperture rate in the sound-absorbing material. That is, it is possible to increase the sound absorption in the frequency range where high sound absorption is desired above that of a muffler having only the sound-absorbing material per se with no thin film, by setting an intrinsic value of a machine-acoustic impedance system constituted by the thin film, the apertures of the sound-absorbing material, etc.

FIG. 3 is a graph of experimental results illustrating the latter improvement in sound absorption. Curves A and B represent the absorption of the same sound-absorbing porous material, the only difference being that the device resulting in curve B was provided with a 10 μm thin film of a nickel-chrome alloy.

To provide the thin film onto the surface of the sound-absorbing member, methods of applying, adhering, bonding, integral molding, sandwiching, etc. are used. Whichever method is employed, it becomes fundamentally possible to prevent the clogging due to the combustion remnants from occurring in the sound-absorbing member and to improve the sound-absorbing rate.

However, an additional problem has been discovered as a result of actually mounting a sound-absorbing device using the sound-absorbing material with the thin film in an internal combustion engine. Since the thin film prevents the gases from passing through the sound-absorbing material, a pressure difference is produced between the surface of the sound-absorbing member in contact with the exhaust gases and the outer surface of the sound-absorbing material. The pressure difference exerts a large amount of tension upon the thin film, thereby increasing the film hardness. Thus, the vibration response property of the film is lowered to thereby cause deterioration in the sound-absorbing rate. Moreover, if the pressure difference becomes too large, the film may be destroyed. Applicants have found, as a countermeasure therefor, a method of reducing the pressure difference by providing a pressure balancing opening, which is formed by cutting away a part of each of the sound-absorbing material and the thin film. That is, as shown in FIGS. 4(*a*) and 4(*b*), a thin film 9 is formed between a perforated pipe 3 and a metallic porous body 7, and a pressure balance opening 10 is formed by cutting away a part of each of the metallic porous body 7 and the thin film 9. In this arrangement, although an exhaust gas is scattered out in the air through an exhaust gas passage constituted by an inlet pipe 1, the perforated pipe 3 and an outlet pipe 4, a part of the exhaust gas is allowed to flow into or out of a casing 2 through the balance opening 10, so that the pressure difference at the opposite sides of the thin film 9 may be reduced. This prevents the thin film from being destroyed and allows the thin film to act effectively to increase the sound-absorbing properties of the muffler. A muffler of this type is described in U.S. application Ser. No. 531,894, filed July 5, 1983.

As described above, in an exhaust gas muffler constituted by a thin film, a sound-absorbing material and a balance opening hole, as illustrated in FIGS. 4(*a*) and 4(*b*), the sound-absorbing properties of the sound-absorbing material are considerably improved over that of a sound-absorbing material with no thin film. However, the sound-absorbing properties decrease in a frequency band below 200 Hz.

SUMMARY OF THE INVENTION

A muffler in accordance with the present invention does not rely solely upon a sound-absorbing body with a thin film as described above, but utilizes a hybrid structure having an expanding sound-deadening portion to broaden the bandwidth of the sound-absorption properties.

The present invention relates to a muffler for an exhaust gas constituted by an expanding chamber and an exhaust gas passage. An object is to increase the bandwidth of the sound-deadening performance of a muffler by providing a cylindrical sound-absorbing body in which a thin film is sandwiched between a perforated pipe and a cylindrical porous sound-absorbing material surrounding concentrically the perforated pipe, and by forming a part of an exhaust gas passage by the cylindrical sound-absorbing body.

BRIEF DESCRIPTION OF THE DRAWINGS

FIG. 1(*b*) is a sectional view taken along the line A—A in FIG. 1(*a*);

FIG. 2(*b*) is a sectional view taken along the line A—A in FIG. 2(*a*).

FIG. 4(*b*) is a sectional view taken along the line A—A of FIG. 4(*a*);

FIG. 5(*b*) is a sectional view taken along the line A—A of FIG. 5(*a*);

DETAILED DESCRIPTION OF THE INVENTION

Figure 5A:
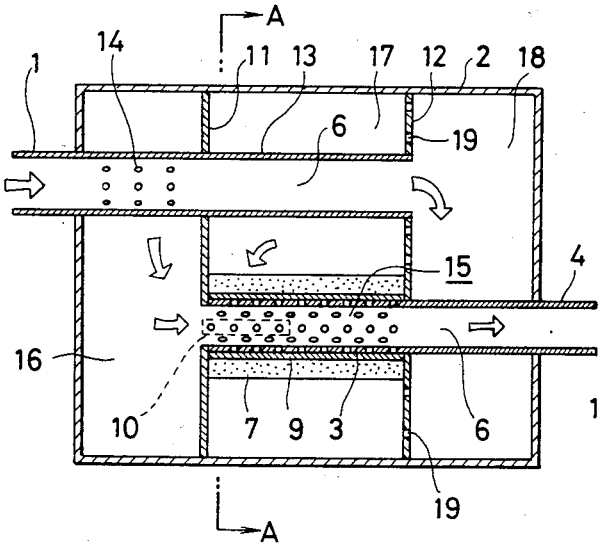
FIG. 5(*a*) is a sectional view showing an embodiment of a muffler according to the present invention.
Figure 5B:
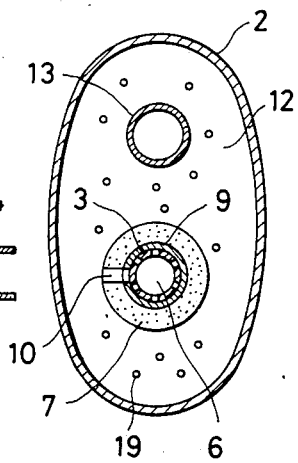

Each of FIGS. 5(*a*) and 5(*b*) is a sectional view of a single embodiment of the hybrid type muffler according to the present invention. The reference numerals 11 and 12 designate partitions dividing the space of a casing 2 into three chambers. An inserted pipe 13, which is connected with an inlet pipe 1, passes through the partitions 11 and 12, and terminates at a portion of the partition 12. A plurality of inflow openings 14 are bored in the inserted pipe 13 at the gas inflow side. A cylindrical sound-absorbing body 15 consists of a perforated pipe 3, a metallic porous material 7 arranged concentrically with the perforated pipe 3, and a thin film 9 sandwiched between the metallic porous body 7 and the perforated pipe 3. The thin film 9 is preferably a metallic thin film of Ni-Cr having a thickness of 10 μm, though other films and thicknesses may be provided as disclosed in the above-mentioned application. The cylindrical sound-absorbing body 15 forms an exhaust gas passage 6 by arranging the position of the partition 11 at the starting point, crossing the partitions 11 and 12, and connecting with an outlet pipe 4 in the casing. The metallic porous body 7 is constructed of a Ni-Cr sponge-like metallic porous material, though other materials may be used as disclosed in the above-mentioned application. In the cylindrical sound-absorbing body 15, the thin film 9 and the metallic porous material 7 are cut away at a part thereof at the exhaust gas inflow side to form a pressure balance opening hole 10, as described above. The reference numerals 16, 17 and 18 designate expansion chambers formed in the casing 2 by partitions 11 and 12. A plurality of sound-deadening performance control holes 19 are bored in the partition 12.

In the hybrid type muffler shown in FIGS. 5(*a*) and 5(*b*), the exhaust gas flows in the direction indicated by arrows in FIG. 5(*a*). A part of the exhaust gas which flows into the inlet pipe 1 enters the expanding chamber 16 through the inflow openings 14, and the rest of the exhaust gas flows into the expanding chamber 18 via the inserted pipe 13. The exhaust in the expanding chamber 16 passes through the cylindrical sound-absorbing body 15 and the otlet pipe 4 and is scattered out into the air. On the other hand, the exhaust gas which has entered the expanding chamber 18 via the inserted pipe 13 flows into the expanding chamber 17 through the control holes 19, enters the cylindrical sound-absorbing body 15 through the pressure balance opening 10, and then is scattered out in the air through the cylindrical sound-absorbing body 15 and the outlet pipe 4. The functions of the thin film 9 and the metallic porous body 7 with respect to an exhaust gas have been already described above.

The inflow openings 14, the control holes 19 and the inserted pipe 13 operate as an acoustic reactance, and each of the expanding chambers 16, 17 and 18 operates as an acoustic capacitance, so that the low-frequency sound of the exhaust gas is effectively deadened. The higher-frequency sound is reduced by the sound-deadening action of the sound-absorbing material such as the metallic porous material 7 constituting the cylindrical sound-absorbing body. Thus, according to this arrangement, the sound-deadening effect can be realized over a wide frequency band.

It has been found that the sound-deadening performance in the low-frequency range is adjustable by controlling the size of the openings 19 and by changing the inner diameter of the inserted pipe 13.

Since the diameters of the inflow openings 14 and the control holes 19 are small, secondary frequency fluid sound is apt to occur when the exhaust gas passes through these small openings. However, it is possible to completely deaden such fluid sound by the sound-absorbing material such as the metallic porous body 7 constituting the cylindrical sound-absorbing body 15.

Figure 7:
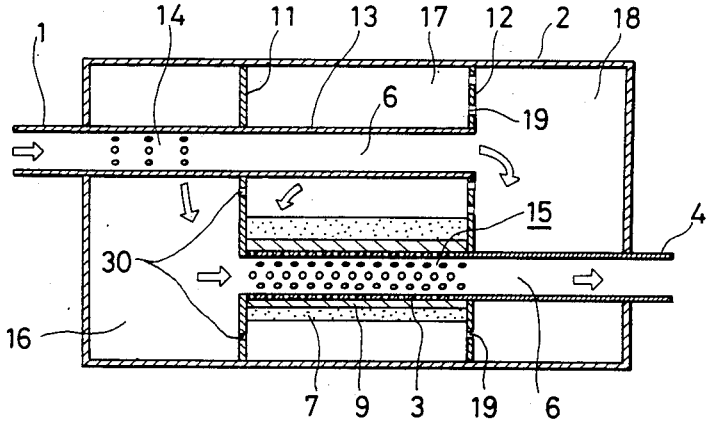
FIG. 7 is a sectional view showing a variation of the embodiment shown in FIG. 5(*a*).

The pressure balance opening hole 10, which in FIGS. 5(*a*) and 5(*b*) is constructed by removing a portion of the thin film 9 and a portion of the porous material 7, need not have the exact construction as shown in FIGS. 5(*a*) and 5(*b*). It may comprise any other structure which provides a pressure balance communication between the gas at the interior of the thin metal film and that exterior of the cylindrical porous metal. One such alternate structure is shown in FIG. 7, wherein pressure balance opening holes 30 in partition wall 11 have replaced the pressure balance opening hole 10 of FIGS. 5(*a*) and 5(*b*). All other parts of FIG. 7 are identical to FIGS. 5(*a*) and 5(*b*).

Figure 1A:
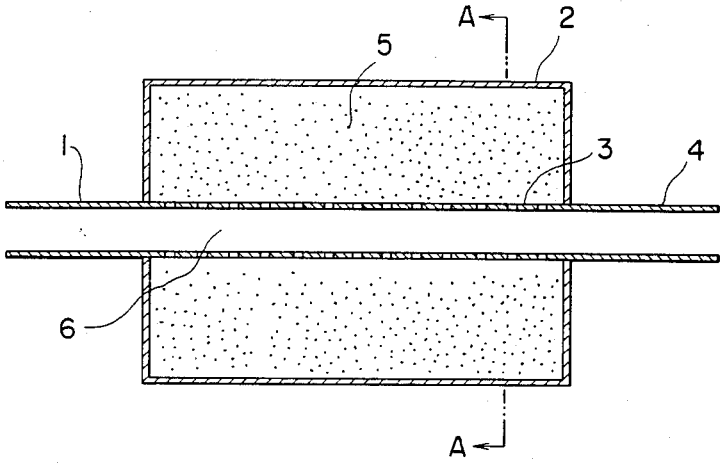
FIG. 1(a) PRIOR ART
FIG. 1(*a*) is a sectional view showing a conventional absorbing type muffler for an exhaust gas.
Figure 1B:
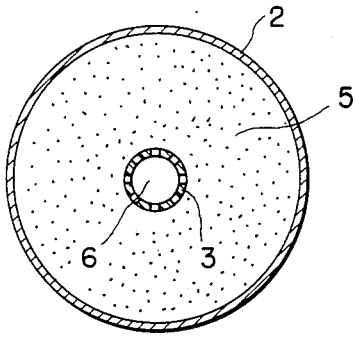
FIG. 1(b) PRIOR ART
Figure 2A:
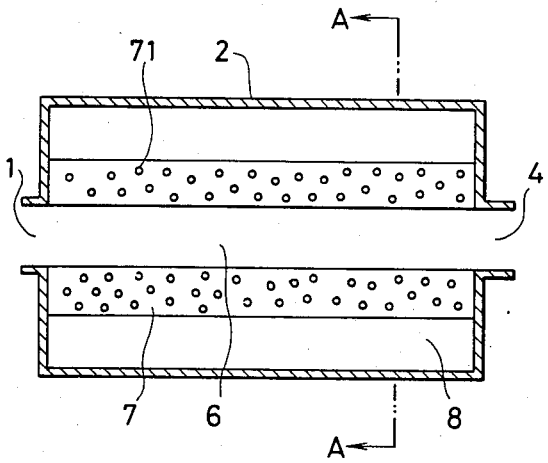
FIG. 2(a) PRIOR ART
FIG. 2(*a*) is a sectional view showing an improved absorbing type muffler for exhaust gas.
Figure 2B:
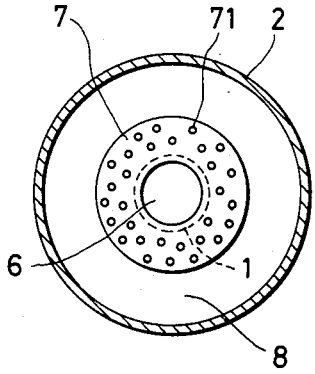
FIG. 2(b) PRIOR ART
Figure 3:
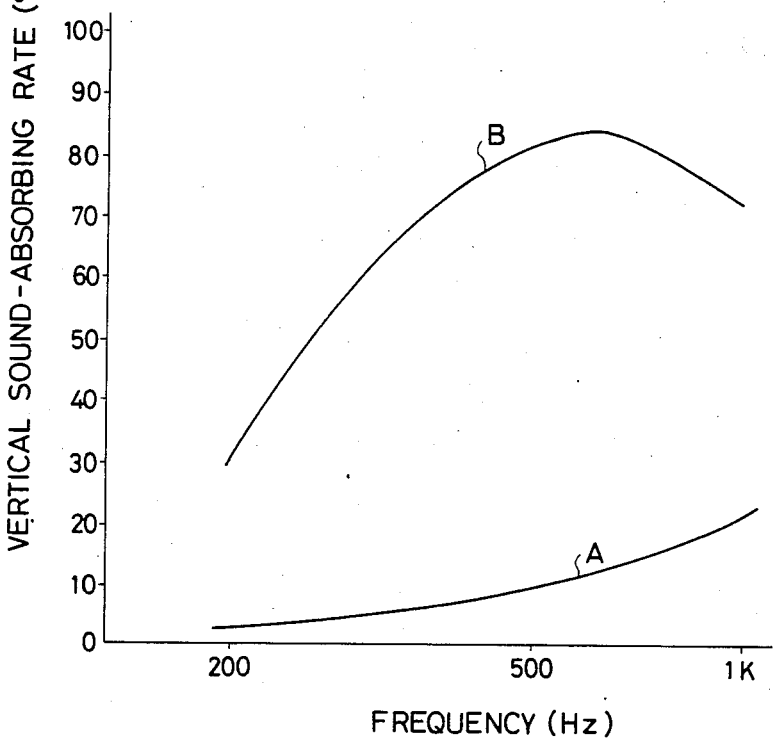
FIG. 3 is a characteristic diagram showing the sound-absorbing rate of a sound-absorbing material with a thin film and a sound-absorbing member with no thin film.
Figure 4A:
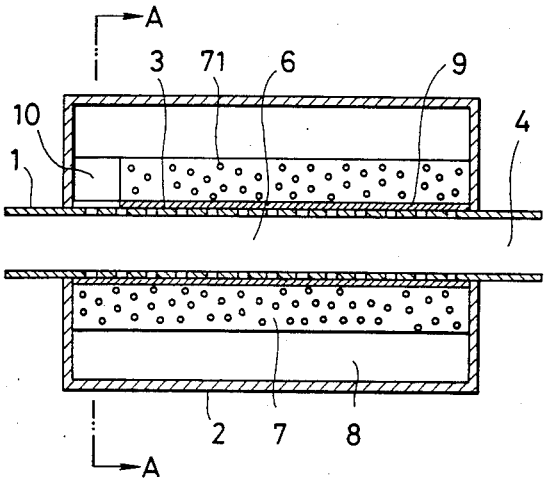
FIG. 4(*a*) is a sectional view showing a muffler of the type in which a thin film is sandwiched between a perforated pipe and a sound-absorbing material.
Figure 4B:
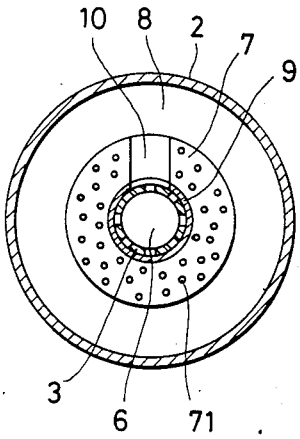
Figure 6:
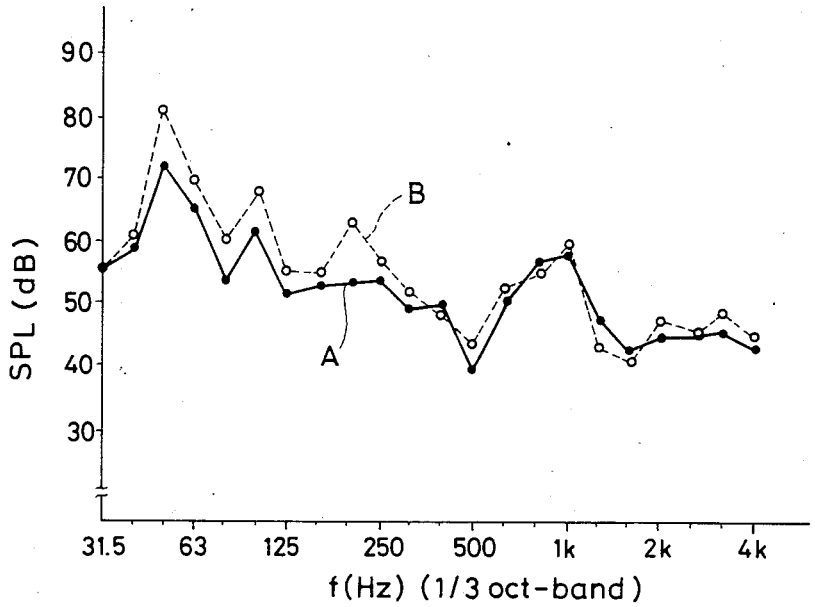
FIG. 6 is a characteristic diagram showing the respective sound-absorbing performances of a muffler as shown in FIGS. 4(*a*) and 4(*b*) and a muffler according to an embodiment of the present invention as shown in FIGS. 5(*a*) and 5(*b*)

In FIG. 6, curved line A shows the sound-deadening performance of a muffler constructed according to the embodiment as shown in FIGS. 5(*a*) and 5(*b*). Curved line B shows the sound-deadening performance of a device constructed in accordance with FIGS. 4(*a*) and 4(*b*). As seen in this characteristic diagram, it is apparent that the sound-deadening performance is improved in a low-frequency band, that is, in a frequency band under 200 Hz.

Although the resistance to the flow of the exhaust gas increases by providing a muffler of the hybrid type, it has been experimentally confirmed that the increase may be suppressed under 2–3% in comparison with the conventional type. The exhaust gas sound-deadening device may be effectively used as a muffler for an automobile.

Although the embodiment has been described above for the case where the cylindrical sound-absorbing body 15 is connected to the outlet pipe 4, the invention is not restricted to this case. As an alternative, the body 15 may be connected to the inserted pipe 13.

Further, although in the above example a single inserted pipe is provided, it is not necessary to restrict the invention to only a single inserted pipe. Also, the number of the partitions, the chambers, etc. is not restricted to that illustrated in the embodiment of FIGS. 5(*a*) and 5(*b*).

As the sound-absorbing material constituting the cylindrical sound-absorbing body, a metallic porous body (Ni-Cr) has been mentioned. Other materials, such as glass wool, rock wool, a ceramic porous body, or the like can be used.

We claim:

1. A muffler for exhaust gas of an internal combustion engine comprising, (a) a casing having an inlet and an outlet for receiving an expelling, respectively, said exhaust gas, (b) a cylindrical sound-absorbing body comprising, (i) a first, perforated pipe having openings formed therein, (ii) a cylindrical porous sound-absorbing material concentrically surrounding said perforated pipe, (iii) and a thin film sandwiched between said perforated pipe and said sound-absorbing material.

(c) means for balancing the gas pressure between the space which is surrounded by said first perforated pipe, said thin film and said sound-absorbing material, and the space surrounding said sound-absorbing material, (d) said cylindrical sound-absorbing body being positioned within said casing to cause said exhaust gas flowing from said inlet to said outlet to pass through said first, perforated pipe, (e) at least one partition within said casing defining a plurality of gas expansion chambers, the downstream end of said first, perforated pipe communicating with said casing outlet, a plurality of small diameter holes within said at least one partition to communicate between expansion chambers on opposite sides of the at least one partition, and one of said expansion chambers forming said space surrounding said sound-absorbing material whereby; exhaust gas entering said inlet expands within said other of said expansion chambers, passes through said small diameter holes within said at least one partition prior to passage through said first perforated pipe and is further expanded within said one of said expansion chambers on the opposite side of said at least one partition whereby said small diameter holes within said at least one partition control the sound deadening performance of the muffler in the low-frequency range while the exhaust gas expanded within said one expansion chamber improves the propagation of sound waves into the sound-absorbing material, while increasing the vibration response property of the thin film to improve the sound-absorbing capability of the sound-absorbing material to ensure effective increase in the sound-absorbing properties of the muffler and thereby broaden the band width of sound absorption of the muffler.

2. A muffler as claimed in claim 1 further comprising a second pipe in said casing connected between said inlet and said other of said expansion chambers, said second pipe having openings in an upstream portion thereof providing communication between the interior of said second pipe and a further one of said plurality of expansion chambers.

3. A muffler as claimed in claim 2 wherein the upstream opening of said first perforated pipe of said sound-absorbing body opens into said further one of said chambers, and said downstream end of said first perforated pipe communicates with said casing outlet.

4. A muffler as claimed in claim 3 wherein said at least one partition comprise a first and a second partition positioned in said casing to divide said casing into a front part bound by a casing front end wall and said first partition and constituting said further one of said chambers, a middle part bound by said first and second partitions and constituting said one of said chambers, and a third part bound by said second partition and a rear end wall of said casing and constituting said other of said chambers; said outlet being through said rear end wall and said inlet being through said front end wall.

5. A muffler as claimed in claim 4 wherein said second pipe extends from said inlet through said first and second parts to carry exhaust gas from said inlet to said third part.

6. A muffler as claimed in claim 5 wherein said sound-absorbing body is positioned between said first and second partitions and, wherein said first perforated pipe includes a nonperforated extension which passes through said third part to said outlet.

7. A muffler as claimed in claim 6 wherein the holes in said second pipe are only in the portion of said second pipe which passes through said first part.

8. A muffler as claimed in any of claims 1 or 2–7 wherein said means for balancing comprises an exposed portion of said first perforated pipe uncovered by said thin film and said sound-absorbing material.

9. A muffler as claimed in claim 8 wherein said uncovered portion of said first perforated pipe is defined by a cut-away portion of said thin film and said sound-absorbing body.

10. A muffler as claimed in any of claims 5–8 wherein said means for balancing comprises openings in said first partition between said front and middle parts.

* * * * *